United States Patent [19]

Gottschalk

[11] Patent Number: 4,551,928

[45] Date of Patent: Nov. 12, 1985

[54] FIBER REMOVING SIEVE FOR TEXTILE DRYERS

[75] Inventor: Karl-Heinz Gottschalk, Hamburg, Fed. Rep. of Germany

[73] Assignee: Babcock Textilmaschinen GmbH, Seevetal, Fed. Rep. of Germany

[21] Appl. No.: 603,198

[22] Filed: Apr. 23, 1984

[30] Foreign Application Priority Data

Apr. 30, 1983 [DE] Fed. Rep. of Germany ..... 3315755

[51] Int. Cl.[4] ..... F26B 13/02

[52] U.S. Cl. ..... 34/82; 34/155; 34/158; 34/242

[58] Field of Search ..... 34/82, 155, 156, 160, 34/242, 158

[56] References Cited

U.S. PATENT DOCUMENTS

| | | | |
|---|---|---|---|
| 2,713,213 | 7/1955 | Bogaty | 34/82 |
| 3,789,514 | 2/1974 | Faust et al. | 34/82 |
| 4,435,909 | 3/1984 | Williamson, Jr. | 34/82 |

*Primary Examiner*—Larry I. Schwartz

*Attorney, Agent, or Firm*—Collard, Roe & Galgano

[57] ABSTRACT

There is provided a fiber removing sieve for textile dryers which includes two sieve elements, one of which is removable from the recirculating stream of drying air for cleaning as the other element takes over operative removal of fibers from the stream of drying air.

6 Claims, 6 Drawing Figures

FIBER REMOVING SIEVE FOR TEXTILE DRYERS

The present invention relates to a device for removing fibers or slubs carried in a stream of treatment means of heat treatment devices, such as dryers or fixation arrangements for textile goods and the like utilizing circulating air, in which the treatment means is repeatedly blown or recirculated onto the textile goods to be treated and removed therefrom following the treatment process. More particularly, the present invention relates to a fiber catching sieve for textile dryers. The term "circulating air" also applies to a stream of treatment means of other gases or vapors which are caused to circulate.

During the treatment of textile goods, such as drying by a stream of treatment means blown onto the goods or through the goods, the treatment means being in gaseous or vapor form, any fibers not completely attached to the textile goods are removed therefrom and transported in the stream of treatment means. If the treatment means is blown entirely or partially during circulation thereof onto the textile goods, then the stream of treatment means is enriched by these removed fibers or slubs. In order to prevent this effect, it is known to install into the circulation of the treatment means fiber removing sieves, which require cleaning more or less frequently depending on the degree of fiber or slub wastage. Heretofore it has been necessary to interrupt the textile treatment process in order to accomplish this cleaning, since the sieves must be withdrawn from the stream of treatment means, namely from the dryer.

As the cleaning of the sieves is time-consuming and, since several fiber removing sieves are disposed in a drying plant, the cleaning process results in extended down time, which interferes with the economical exploitation of the plant.

In order to overcome this uneconomical down time, a device is proposed by the present invention for cleaning the fiber removing sieves during operation of the plant.

To accomplish this task, it is proposed to implement the fiber removing sieve as a double sieve having two sieve elements, of which one may be withdrawn from the stream of treatment means for the purpose of cleaning the sieve surface, while the other takes over removal of fibers from the stream of treatment means.

Both sieve elements of the double sieve can be arranged in tandem and connected with one another in such manner that when the front sieve element is withdrawn from the stream of treatment means or from the dryer housing, the rear sieve element is brought into operating position in the stream of treatment means.

It is preferred to connect the front and rear sieve elements to one another by entrainment means which pushes the rear sieve element when the front element is pushed and pulls the rear sieve element when the front element is pulled.

In this case one of the entrainment means of the rear sieve element is implemented as a packing or sealing strip for cooperation with a packing or seal in the dryer housing in the operating position of that sieve element.

Both sieve elements of the double sieve may, however, also be disposed one above the other in the stream of treatment means in the dryer housing, and may be withdrawn sequentially in a selectable manner from the stream of treatment means in the dryer housing, for the purpose of cleaning. This embodiment, although being somewhat expensive, has the advantage that both sieve surfaces may be cleaned during normal operation. The slightly higher resistance encountered when both sieve elements are in the stream of treatment means has little effect, as one sieve surface may always be kept clean.

Sealing strips which may be pressed against the dryer housing are provided on the front sieve element, when the two sieve elements are operated in tandem, or on the front part of both sieve elements, when the arrangement is operated so that the sieve elements are disposed one above the other. This prevents the suctioning in of any large quantity of outside air at those locations of the dryer where the withdrawable sieves are located. For pressing the sealing strips against the dryer housing as well as for easy opening, turn buckles actuated by handles can be disposed on the sieve elements.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
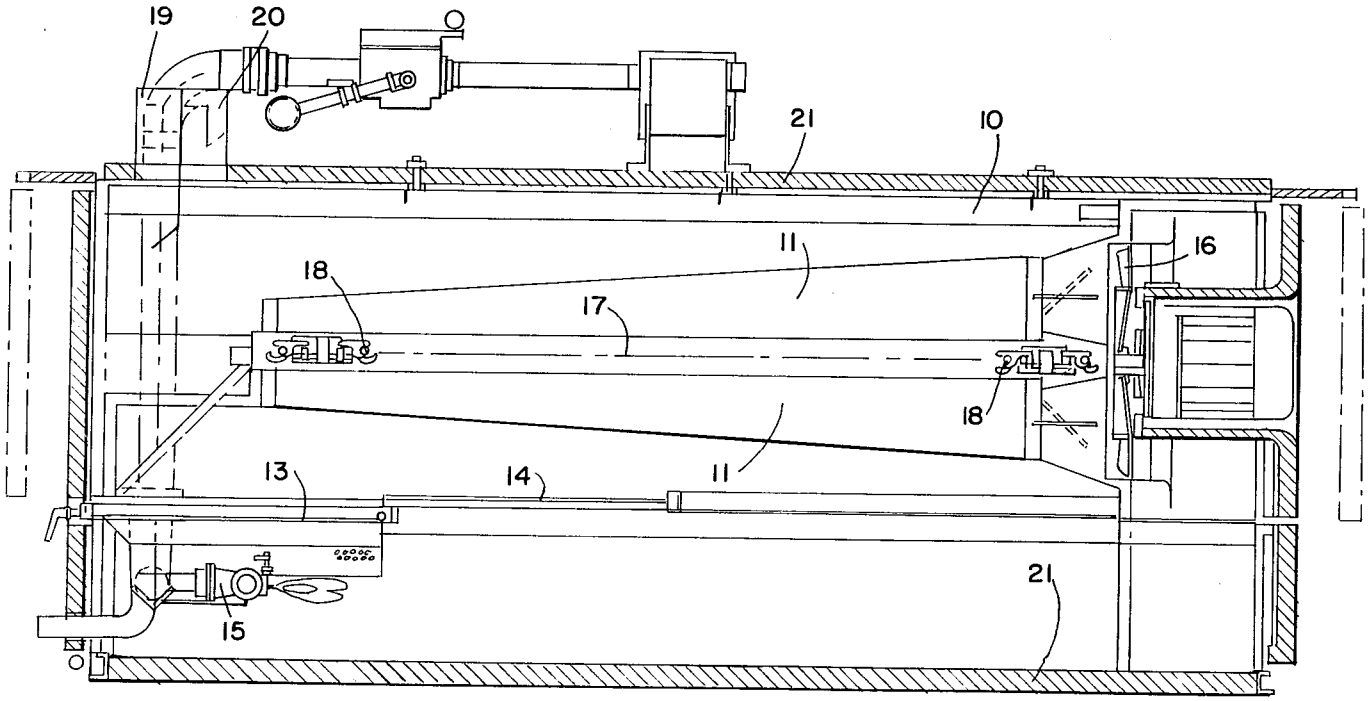
FIG. 1 is a cross-sectional view through the dryer housing.

Now turning to the drawings, there is shown in FIG. 1 a dryer housing, designated 10, provided with insulated walls 21, in which are disposed nozzle housings, designated 11, between which there is guided a track of textile goods 17 held by tension chains 18. The treatment means is blown in a known manner from nozzle housings 11 onto the track of goods and then streams off from the track of goods between the adjoining nozzle housings. Circulation is substantially accomplished by means of a ventilator, designated 16, and a heating device 15 heats the treatment means. On the dryer housing there are further disposed a nozzle 19 for the supply of fresh air and nozzle 20 for discharge of a corresponding amount of exhaust air are disposed on dryer housing 10. The air exhausted from dryer housing 10 is saturated with moisture received from the textile goods during the drying process.

Figure 2:
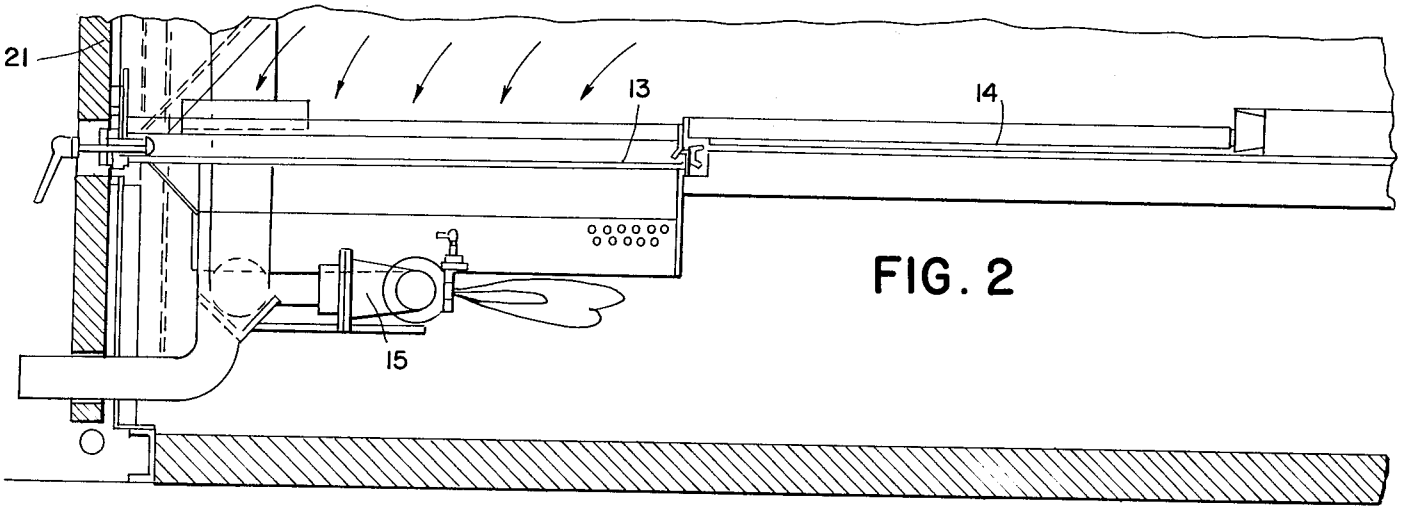
FIG. 2 is an enlarged view of a portion of the dryer housing of FIG. 1 showing two sieve elements disposed in tandem in normal operation.
Figure 3:
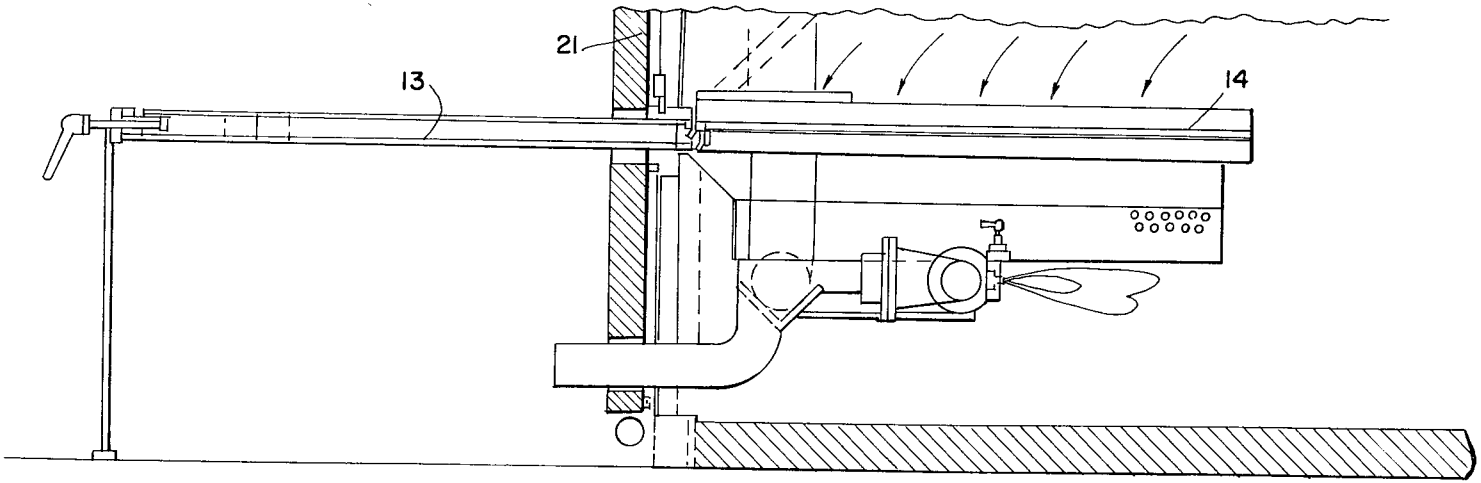
FIG. 3 is a view similar to FIG. 2 showing the sieve elements when the front sieve element is being cleaned.

In the circulating stream of treatment means there are interposed fiber removing sieves 13 and 14, by means of which fibers released from the textile goods are removed from the stream of treatment means. Fiber removing sieves disposed in tandem one behind another can be clearly seen in FIGS. 2 and 3. As shown, sieve element 13 is disposed in front and sieve element 14 is disposed therebehind. The stream of the treatment means is shown by arrows. In FIG. 2, sieve element 13 is in the operating position in the stream of the treatment means while sieve element 14 is desposed in the rear portion of dryer housing 10 external to the stream of the treatment means. In FIG. 3, front sieve element 13 is withdrawn from dryer housing 10 for the purpose of cleaning. Sieve element 14 in this case takes over removal of fibers from the stream of treatment means while sieve element 13 is being cleaned. Following the cleaning, sieve element 13 is again slid into the stream of treatment means and sieve element 14 is again set to rest. These elements can also be cleaned at greater intervals if the plant has to be taken out of operation for any reason whatsoever.

Figure 4:
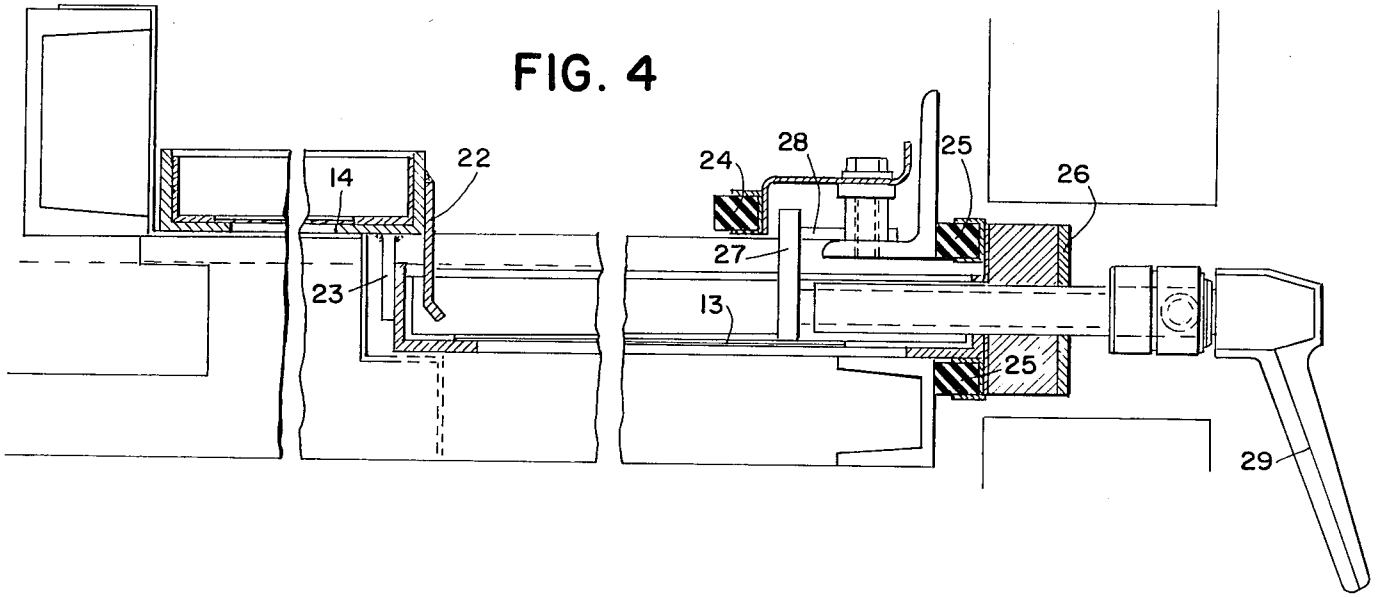
FIG. 4 is a side view of two sieve elements disposed in tandem showing details thereof.
Figure 5:
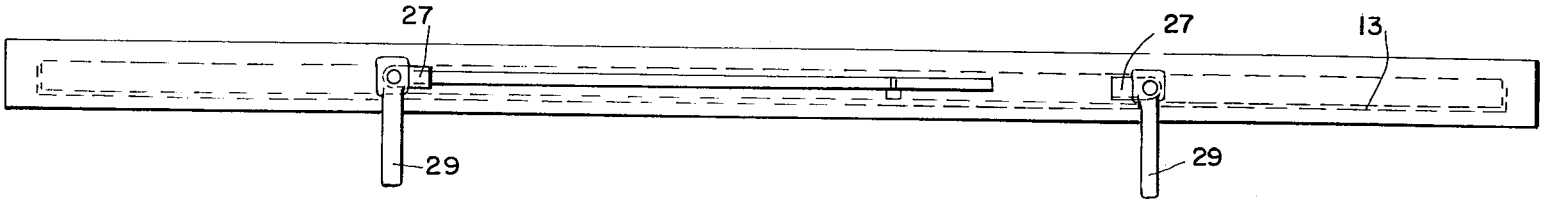
FIG. 5 is a front elevational view of the sieve elements.

In FIG. 4, details of the sequential positioning of sieve elements 13 and 14 can be ascertained. As clearly seen in that Figure, the sieve elements are connected to one another by entrainment means 22 and 23. One entrainment means 23 slides rear sieve element 14 rearwardly, the other entrainment means 22 pulls it forwardly when front sieve element 13 is withdrawn from the dryer housing. In that position, the entrainment means 22, which is simultaneously implemented as a sealing strip, abuts seal or packing 24, and largely prevents suctioning of cold outside air into the stream of the treatment means. Also, when sieve element 13 is slid in, there is accomplished a particularly careful sealing of dryer housing 10 at this location by special sealing strips 25 connected to pressure plates 26 by means of handles 29 and turn buckles 27, when the turn buckles are pulled against stops 28 in the dryer housing. The arrangements of turn buckles 27 with levers 29 on sieve element 13 can also be clearly seen in FIG. 5.

Figure 6:
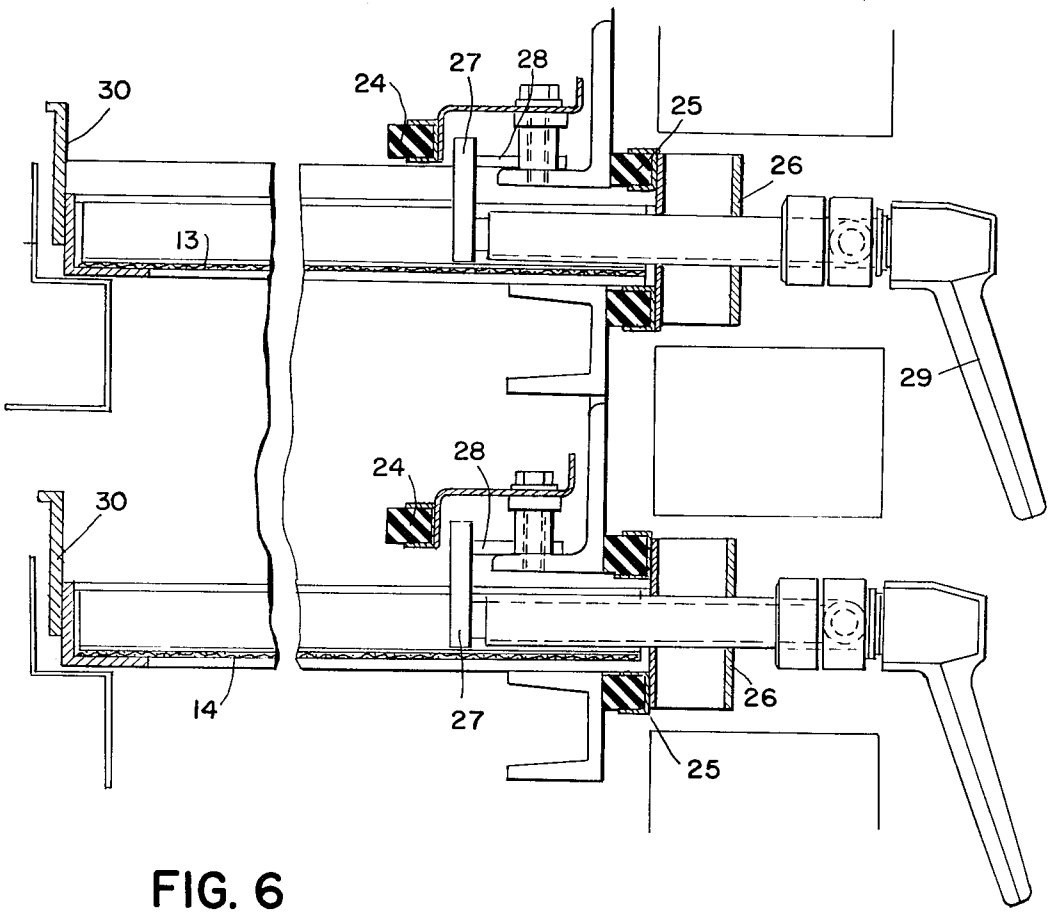
FIG. 6 is a schematic illustration showing two sieve elements disposed one above the other according to another embodiment of the invention.

In FIG. 6 there is shown an arrangement of two sieve elements 13 and 14 which are disposed one above the other. This version of the individual sieve elements with the seals 24, 25, and turn buckles 26, 27, 28 and 29, corresponds substantially to that of FIG. 4. At the rear end of each sieve element there is attached a special sealing strip 30, which abuts inner seal 24 when the sieve element is pulled forwardly and thus prevents suctioning in of any outside air.

While only two embodiments of the present invention have been shown and described, it will be obvious that many changes and modifications may be made thereunto without departing from the spirit and scope of the invention.

What is claimed is:

1. In a device for removing fibers or slubs transported in a stream of treatment means in treatment devices, such as dryers or fixation devices for textile goods or the like using circulating air, in which the treatment means is blown repeatedly onto the textile goods to be treated and, after the treatment process, the treatment means is removed therefrom of the type having a housing and a fiber removing sieve mounted in said housing for movement between an operative position in which it is in the path of said stream of treatment means for removing fibers and an inoperative position where it is withdrawn from said stream for cleaning, the improvement comprising:

said fiber removing sieve including two sieve elements disposed in tandem, and connected to one another by entrainment means so that in pushing on one sieve element the other element is pushed, and in pulling on one sieve element the other element is pulled, whereby as one of said sieve elements is moved into the operative position, the other of said sieve elements is moved into said inoperative position, said entrainment means including sealing means for cooperating with said dryer housing to prevent outside air from entering into the stream of treatment means when one of said sieve elements is disposed in said operative position.

2. The device according to claim 1, wherein said sieve elements are disposed one above the other in the stream of treatment means in the dryer housing, said sieve elements being withdrawable sequentially and selectively from the stream of treatment means so that it can be cleaned.

3. The device according to claim 1, wherein sealing strips are provided on the front sieve element which are pressed against the dryer housing when the sealing element is in its operating position.

4. The device according to claim 3, which further includes turn buckles on the sieve elements actuated by handles for pressing the sealing strips against the dryer housing.

5. The device according to claim 2, wherein sealing strips are provided on the front parts of both sieve elements.

6. The device according to claim 5, which further includes turn buckles on the sieve elements actuated by handles for pressing the sealing strips against the dryer housing.

* * * * *